US009151522B2

(12) United States Patent
Choi

(10) Patent No.: US 9,151,522 B2
(45) Date of Patent: Oct. 6, 2015

(54) AIR CONDITIONER AND CONTROL METHOD THEREOF

(71) Applicant: Bongsoo Choi, Seoul (KR)

(72) Inventor: Bongsoo Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 431 days.

(21) Appl. No.: 13/658,499

(22) Filed: Oct. 23, 2012

(65) Prior Publication Data

US 2013/0098072 A1 Apr. 25, 2013

(30) Foreign Application Priority Data

Oct. 24, 2011 (KR) ..... 10-2011-0108850

(51) Int. Cl.
*F25B 13/00* (2006.01)
*F25B 49/02* (2006.01)
*F25B 45/00* (2006.01)

(52) U.S. Cl.
CPC ..... *F25B 13/00* (2013.01); *F25B 45/00* (2013.01); *F25B 49/02* (2013.01); *F25B 2313/0233* (2013.01); *F25B 2313/02741* (2013.01); *F25B 2400/075* (2013.01); *F25B 2400/13* (2013.01); *F25B 2400/16* (2013.01); *F25B 2600/05* (2013.01); *F25B 2600/2523* (2013.01); *F25B 2700/2104* (2013.01); *F25B 2700/2106* (2013.01)

(58) Field of Classification Search
CPC .... F25B 40/02; F25B 45/00; F25B 2345/001; F25B 2345/002; F25B 2345/003; F25B 2345/006; F25B 2400/16; F25B 2500/07; F25B 2500/23; F25B 2500/24; F25B 2600/2523; F25B 2700/2106
USPC ..... 62/149, 174, 324.4, 509
See application file for complete search history.

(56) References Cited

U.S. PATENT DOCUMENTS

| | | | | |
|---|---|---|---|---|
| 3,736,763 | A * | 6/1973 | Garland | 62/85 |
| 3,844,131 | A * | 10/1974 | Gianni et al. | 62/149 |
| 6,209,338 | B1 * | 4/2001 | Thatcher, Jr. | 62/292 |
| 2010/0293975 | A1 * | 11/2010 | Kawano et al. | 62/149 |

FOREIGN PATENT DOCUMENTS

| | | | |
|---|---|---|---|
| EP | 1 304 532 | A1 | 4/2003 |
| EP | 2 075 518 | A2 | 7/2009 |
| JP | 2002-031387 | A | 1/2002 |
| JP | 2002-195705 | A | 10/2002 |

(Continued)

OTHER PUBLICATIONS

Partial European Search Report dated Apr. 22, 2014 issued in Application No. 12 16 6999.8.
Korean Notice of Allowance dated Feb. 13, 2013 issued in Application No. 10-2011-0108850.

(Continued)

*Primary Examiner* — Marc Norman
(74) *Attorney, Agent, or Firm* — Ked & Associates, LLP

(57) ABSTRACT

An air conditioning system has a controller and a receiver located between an indoor and outdoor units. The receiver serves as an auxiliary reservoir for refrigerant. The controller generates signals to adjust the amount of refrigerant to be stored in this reservoir as a way of adjusting the amount of refrigerant flowing in the system during various modes of operation. By increasing or decreasing the amount of refrigerant in the receiver, the controller may achieve or maintain a desired level of performance and/or efficiency.

17 Claims, 7 Drawing Sheets

(56) References Cited

FOREIGN PATENT DOCUMENTS

| | | | |
|---|---|---|---|
| KR | 10-2009-0071346 | A | 7/2009 |
| WO | WO 2009/029506 | A1 | 3/2009 |

OTHER PUBLICATIONS

European Search Report dated Nov. 24, 2014 issued in application No. 12166999.8.

* cited by examiner

AIR CONDITIONER AND CONTROL METHOD THEREOF

CROSS-REFERENCE TO RELATED APPLICATIONS

The present application claims priority under 35 U.S.C. 119 and 35 U.S.C. 365 to Korean Patent Application No. 10-2011-0108850 filed on Oct. 24, 2011, which is hereby incorporated by reference in its entirety.

BACKGROUND

1. Field

One or more embodiments herein relate to an air conditioner.

2. Background

The amount of refrigerant required by an air conditioner tends to vary based on external air conditions, indoor load conditions, and/or operational mode. Attempts have been made to control the amount of refrigerant during these conditions or modes. However, they have proven to be inaccurate, inefficient, or both.

SUMMARY

Embodiments disclosed herein relate to an air conditioner and a method for controlling an air conditioner. In accordance with one embodiment, the air conditioner includes an outdoor unit comprising a compressor and an outdoor heat exchanger, at least one indoor unit comprising an indoor heat exchanger, a conduit coupling the outdoor and indoor units, a receiver to store a portion of refrigerant flowing through the conduit, and a controller to adjust an amount of refrigerant to be stored in the receiver based on information from one or more sensors. A first sensor may determine external temperature and a second sensor may determine a load of the indoor unit.

In accordance with another embodiment, a method of controlling an air conditioner includes determining an operational mode of the air conditioner, determining at least one of an external temperature or a load of an indoor unit before operation of a compressor corresponding to the operational mode, operating the compressor, and adjusting an amount of refrigerant to be introduced into or discharged from a receiver based on at least one of the external temperature or load of the indoor unit, wherein the refrigerant is to be introduced into the receiver from or discharged from the receiver to a conduit coupled between the indoor unit and an outdoor unit.

DETAILED DESCRIPTION

Figure 1:
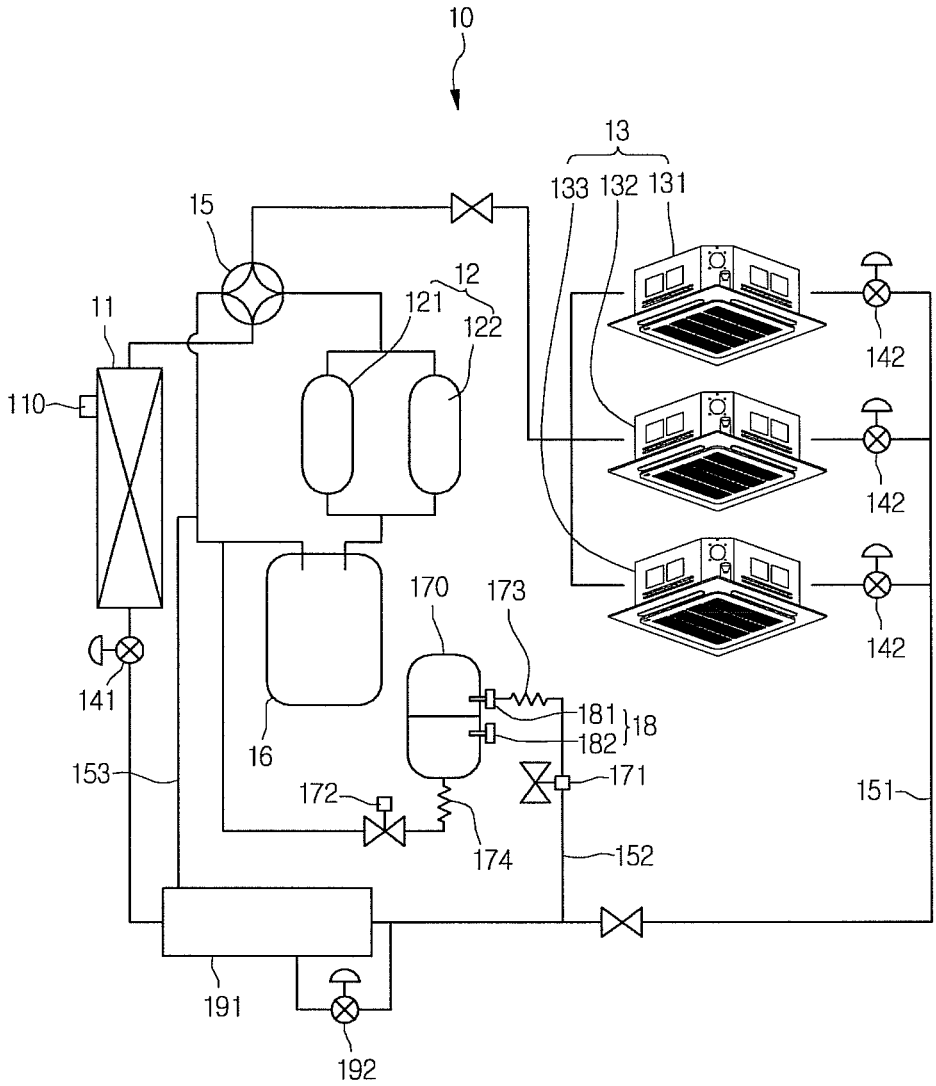
FIG. 1 shows one embodiment of an air conditioner.

An air conditioner may maintain indoor air in an optimized condition according to its use and purpose. For example, indoor air may be cooled in summer and heated in winter, and indoor humidity may be controlled to adjust the indoor air to a comfortable state. More specifically, an air conditioner may perform a refrigeration cycle for compressing, condensing, expanding, and evaporating refrigerant, to thereby cool or heat a set space such as an indoor space.

Air conditioners may be classified into separate-type air conditioners in which an indoor unit is separated from an outdoor unit, and integrated air conditioners in which an indoor unit and an outdoor unit are integrated. An outdoor unit may include a compressor and an outdoor heat exchanger exchanging heat with external air, and an indoor unit may include an indoor heat exchanger exchanging heat with indoor air.

During a cooling operation, the outdoor heat exchanger may function as a condenser and the indoor heat exchanger as an evaporator. During a heating operation, the indoor heat exchanger may function as a condenser and the outdoor heat exchanger as an evaporator.

The amount of circulating refrigerant required by an air conditioner may vary based on operational mode, e.g., according to whether a cooling operation or a heating operation is to be performed. The amount of refrigerant circulating through a refrigeration cycle in a heating operation may be greater than in a cooling operation. If so, a larger amount of refrigerant to be compressed in a compressor may be required.

The amount of refrigerant required by an air conditioner may also vary according to an external air condition or an indoor load condition. During a cooling operation, when external temperature is higher than a reference temperature, a pressure of a refrigeration cycle (e.g., discharge pressure of a compressor) is increased. Then, when the amount of refrigerant circulating through a refrigeration system is increased, the pressure is further increased and thus an entire pressure distribution of the refrigeration cycle is greater than a normal or desired pressure. As a result, cooling performance is degraded and a system error (caused by the high pressure) may occur.

During a heating operation, when an external temperature is lower than the reference temperature, a low pressure of the refrigeration cycle may occur, e.g., evaporation pressure is decreased. Then, when the amount of refrigerant circulating through the refrigeration system is decreased, the pressure is further decreased and thus an entire pressure distribution of the refrigeration cycle is lower than a normal or desired pressure. As a result, heating performance is degraded and a system error (caused by the low pressure) may occur.

Furthermore, when the number of operating indoor units increases, an indoor load is increased and a required amount of refrigerant is increased. Conversely, when the indoor load is decreased, a required amount of refrigerant is decreased.

In accordance with one or more embodiments described herein, the amount of refrigerant circulating through the system may be controlled without changing an operation rate of the compressor based, for example, on an indoor load. This is accomplished by increasing or decreasing the amount of refrigerant stored in a receiver, which, in turn, regulates the amount and/or pressure of refrigerant operating in the system.

This way, the refrigerant may operate as an auxiliary reservoir coupled to be located outside the system proper.

FIG. 1 shows one embodiment of an air conditioner 10 that includes an outdoor heat exchanger 11 where outdoor air exchanges heat with refrigerant, a compressor 12 for compressing the refrigerant, an indoor heat exchanger 13 where indoor air exchanges heat with the refrigerant, expansion parts 141 and 142 for expanding the refrigerant, and a main refrigerant tube 151 connecting the outdoor heat exchanger 11, the compressor 12, the indoor heat exchanger 13, and the expansion parts 141 and 142 to one another to form a refrigerant cycle.

The air conditioner 10 also includes an accumulator 16 for removing liquid refrigerant from the refrigerant flowing to the compressor 12 and a flow direction switching part 15 for selectively switching a flow direction of the refrigerant discharged from the compressor 12 to the outdoor heat exchanger 11 or the indoor heat exchanger 13. The flow direction switching part 15 may switch the flow direction of the refrigerant, for example, according to an operational mode of the air conditioner 10.

The indoor heat exchanger 13 includes indoor heat exchanger parts 131, 132, and 133, which are disposed in indoor spaces respectively. The compressor 12 includes a constant-speed compressor 121 having a constant compression capacity and an inverter compressor 122 having a variable compression capacity.

The expansion parts 141 and 142 include an outdoor expansion part 141 adjacent to an inlet of the outdoor heat exchanger 11 and indoor expansion parts 142 adjacent to inlets of the indoor heat exchanger 13. The indoor expansion parts 142 may correspond to the indoor heat exchanger parts 131, 132, and 133 respectively.

According to one embodiment, the indoor expansion parts 142 selectively cut off refrigerant flowing into the indoor heat exchanger parts 131, 132, and 133 according to whether the indoor heat exchanger parts 131, 132, and 133 are operating. The outdoor expansion part 141 and the indoor expansion parts 142 may include a valve for adjusting the degree of opening such as an electronic expansion valve (EEV).

When the air conditioner 10 is performing a heating operation, the indoor expansion parts 142 are fully opened and the outdoor expansion part 141 is partially opened. Thus, the refrigerant discharged from the indoor heat exchanger 13 may pass through the indoor expansion parts 142 without undergoing phase change, be expanded through the outdoor expansion part 141, and then be introduced into the outdoor heat exchanger 11.

When the air conditioner 10 is performing a cooling operation, the outdoor expansion part 141 is fully opened and the indoor expansion parts 142 are partially opened. Thus, refrigerant discharged from the outdoor heat exchanger 11 may pass through the outdoor expansion part 141 without undergoing phase change, be expanded through one or more indoor expansion parts 142, and then be introduced into indoor heat exchanger 13.

Figure 2:
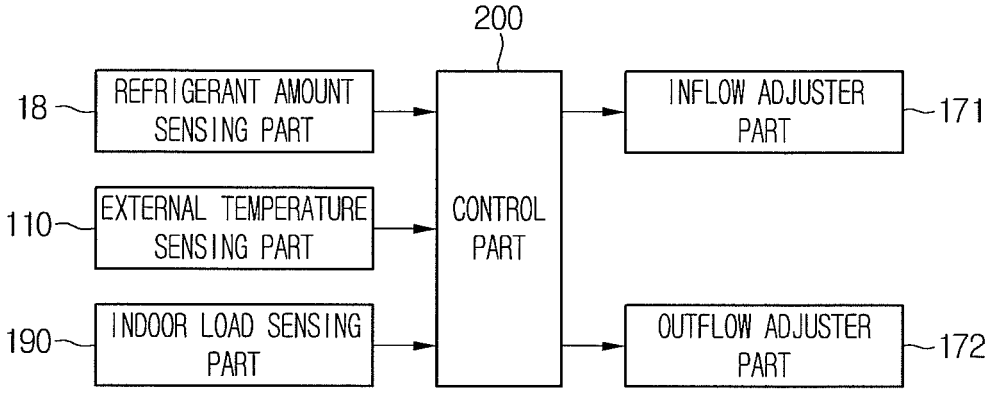
FIG. 2 shows a block diagram of the air conditioner in FIG. 1.

The air conditioner 10 may further include a refrigerant amount adjuster part for adjusting a flow rate of the refrigerant circulating through a refrigeration cycle. As shown in FIGS. 1 and 2, the refrigerant amount adjuster part includes a receiver 170 for storing at least one portion of the refrigerant circulating through the refrigeration cycle, an inflow adjuster part 171 for adjusting an amount of the refrigerant introduced into the receiver 170, and an outflow adjuster part 172 for adjusting an amount of the refrigerant discharged from the receiver 170.

The refrigerant amount adjuster part may also includes a refrigerant amount sensing part 18 for sensing an amount of the refrigerant stored in the receiver 170, flow rate limiting parts 173 and 174 for limiting a flow rate of the refrigerant flowing through the receiver 170, and a storage refrigerant tube 152 guiding a refrigerant flow between the main refrigerant tube 151 and the receiver 170. In one embodiment, the receiver 170 may be a storage container for storing at least one portion of the refrigerant circulating through the refrigeration cycle such as a refrigerant tank.

The inflow adjuster part 171 is installed on the storage refrigerant tube 152 at an inflow side of the receiver 170. The outflow adjuster part 172 is installed on the storage refrigerant tube 152 at an outflow side of the receiver 170. The inflow adjuster part 171 and the outflow adjuster part 172 may be, for example, opening/closing valves for selectively cutting off refrigerant flow.

For example, the flow rate limiting parts may limit a flow speed or flow rate of the refrigerant introduced into or discharged from the receiver 170, to a set speed or set flow rate or lower, such as a capillary tube. According to one embodiment, an inflow side flow rate limiting part 173 is disposed at the inflow side of the receiver 170 and an outflow side flow rate limiting part 174 is disposed at the outflow side of the receiver 170.

For example, at least one of the inflow adjuster part 171, the inflow side flow rate limiting part 173, the outflow adjuster part 172, and the outflow side flow rate limiting part 174 may include a valve for continuously adjusting the degree of opening such as an electronic expansion valve (EEV).

An end of the storage refrigerant tube 152 may be coupled to a side portion of the main refrigerant tube 151 connecting the outdoor heat exchanger 11 to the indoor heat exchanger 13. The other end of the storage refrigerant tube 152 may be coupled to another side portion of the main refrigerant tube 151 at an inflow side of the accumulator 16. The coupling may be a direct connection or an indirect connection with one or more intervening parts.

When inflow adjuster part 171 is opened, at least one portion of the refrigerant flowing between outdoor heat exchanger 11 and indoor heat exchanger 13 is introduced into receiver 170. When the outflow adjuster part 172 is opened, the refrigerant stored in the receiver 170 may be introduced into the accumulator 16.

The refrigerant amount sensing part 18 may be installed on a side portion of the receiver 170 to sense an amount of the refrigerant stored in the receiver 170. The refrigerant amount sensing part 18 may include level sensors disposed at different heights on the side portion of the receiver 170 to sense a variable level of the refrigerant stored in the receiver 170. The level sensors may include a first sensor 182 installed on the lower portion of the receiver 170 and a second sensor 181 installed on the upper portion of the receiver.

The first sensor 182 may sense whether the receiver 170 is empty (whether an amount of the refrigerant is equal to or smaller than a minimum storage amount).

The second sensor 181 may sense whether the receiver 170 is full of the refrigerant (whether an amount of the refrigerant is equal to or greater than a maximum storage amount). When a level of the refrigerant in the receiver 170 is between the first sensor 182 and the second sensor 181, an amount of the refrigerant may correspond to a standard refrigerant amount.

The level sensors may further include a third sensor in an inner space of the receiver 170 between the first sensor 182 and the second sensor 181. When a third sensor is included, the determination of whether an amount of the refrigerant stored in the receiver 170 corresponds to a standard refrigerant amount may be determined according to whether the third sensor senses the refrigerant.

For example, when a level of the refrigerant is higher than the third sensor, it may be determined that an amount of the refrigerant corresponds to the standard refrigerant amount. When a level of the refrigerant is lower than the third sensor, it may be determined that an amount of the refrigerant is smaller than the standard refrigerant amount. The standard refrigerant amount may denote an appropriate or predetermined amount of refrigerant stored in the receiver 170 to move an appropriate reference amount of refrigerant through the refrigerant cycle at an initial or other stage of operation.

The air conditioner 10 may include a super cooler for supercooling refrigerant discharged from a condenser. The condenser may be one of the outdoor heat exchanger 11 and the indoor heat exchanger 13 according to a cooling mode or a heating mode.

More specifically, the super cooler may includes a bypass tube 153 for guiding a portion of the refrigerant discharged from the condenser to the inflow side of the accumulator 16, a super cooler heat exchanger 191 in which guided refrigerant exchanges heat with refrigerant in the main refrigerant tube 151, and a super cooler adjuster part 192 for adjusting an amount of refrigerant passing through the super cooler heat exchanger 191.

The air conditioner 10 may further include an external temperature sensing part 110 for sensing external temperature. The external temperature sensing part 110 may be installed, for example, on an outdoor unit. A temperature value sensed by the external temperature sensing part 110 may correspond to or be indicative of an operational condition for determining a start control or on-time control of the air conditioner 10.

The air conditioner 10 may also include an indoor load sensing part 190 for sensing an indoor load. The indoor load may correspond to information that relates to an operation ratio of indoor units. For example, the indoor load may correspond to or provide an indication of the number of indoor heat exchanger parts 131, 132, and 133 that are operating and/or an operation capacity thereof. Thus, the indoor load may be considered to increase as the number of indoor spaces to be air conditioned increases.

The air conditioner 10 includes a control part 200 for adjusting the degree of opening of inflow adjuster part 171 or outflow adjuster part 172, based on info nation sensed by at least one of the refrigerant amount sensing part 18, the external temperature sensing part 110, and the indoor load sensing part 190.

Figure 3:
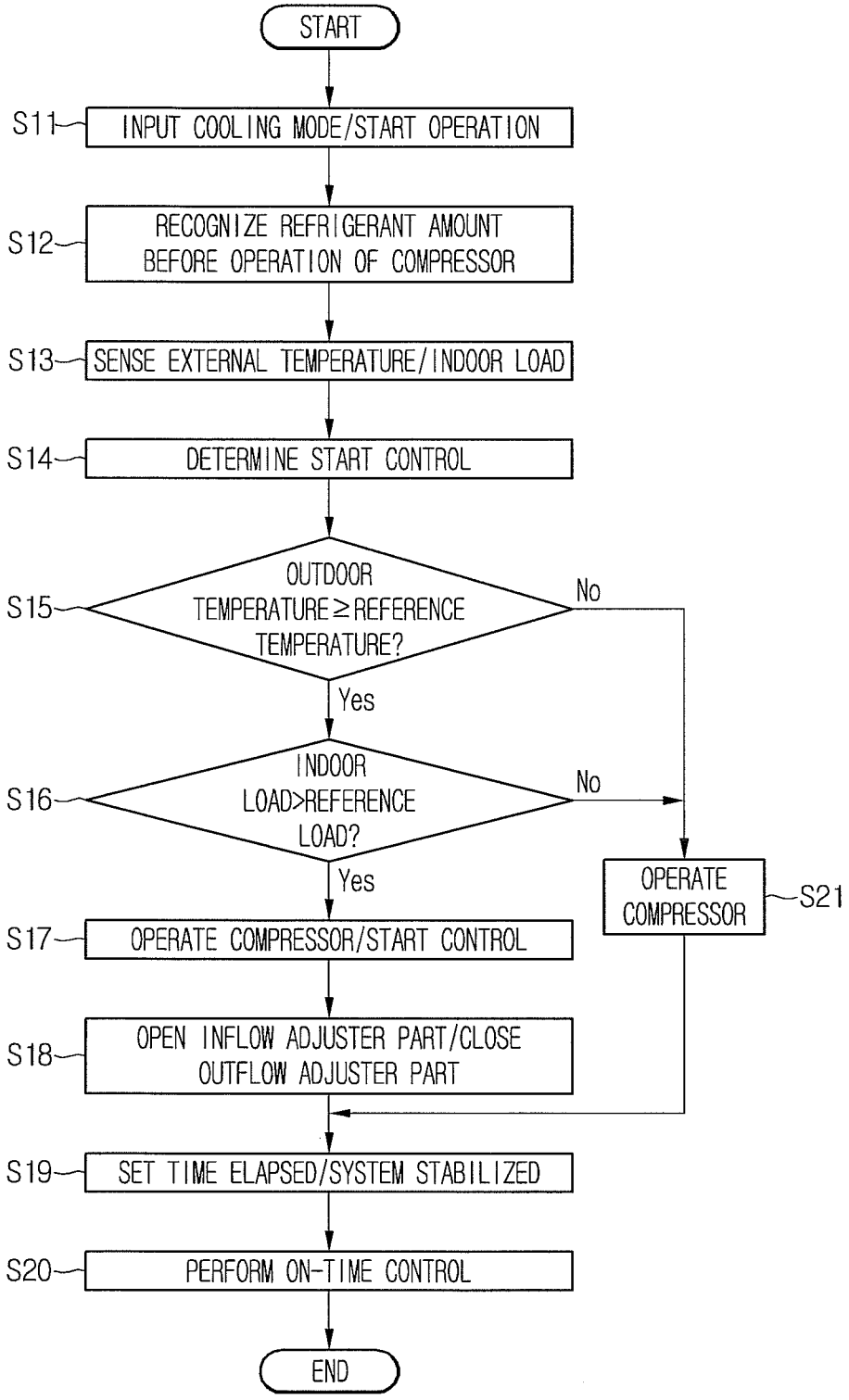
FIG. 3 shows operations included in one embodiment of a method for controlling an air conditioner during a cooling operation.

FIG. 3 shows operations in one embodiment of a method for controlling an air conditioner during a cooling operation. The air conditioner may have a structure as shown in FIGS. 1 and 2 or another structure.

The air conditioner 10 may start to operate when set to enter a cooling mode. The cooling mode may be entered when a corresponding command is input by a user in operation S11. When this command is input, compressor 12 may be driven to perform a refrigeration cycle. Before the compressor is driven, it is determined, in operation S12, whether an amount of refrigerant is excessive or insufficient according to a set condition.

The set condition may correspond to, for example, an external temperature (outdoor temperature) condition and/or an indoor load condition. That is, the external temperature sensing part 110 and indoor load sensing part 190 may respectively sense an external temperature value and an amount of indoor load in operation S13. Whether a start control of the air conditioner 10 is performed may be determined according to the external temperature value and/or the amount of indoor load in operation S14.

More specifically, a determination may be made as to whether an outdoor temperature is equal to or higher than a reference temperature in operation S15. If the outdoor temperature is equal to or higher than the reference temperature, it is determined whether the indoor load is greater than a reference load in operation S16.

If the outdoor temperature is equal to or higher than the reference temperature and the indoor load is greater than the reference load, start control may be performed. The start control may include control of filling the receiver 170 with refrigerant to decrease an amount of refrigerant circulating through a refrigeration system. In the embodiment shown in FIG. 1, this may be accomplished by opening inflow adjuster part 171 to introduce refrigerant into the receiver 170 and closing outflow adjuster part 172 to prevent refrigerant from being discharged from the receiver 170.

When outdoor temperature is high in a cooling operation, pressure in the refrigeration system (e.g., a discharge pressure of the compressor) is increased. When the pressure in the refrigeration system is increased excessively, for example, as a result of increasing the amount of circulating refrigerant, cooling performance and efficiency may be significantly degraded and the overall stability of the refrigeration system may be jeopardized. To compensate, the receiver 170 is filled with refrigerant to decrease the amount of the refrigerant circulating through the refrigeration system, and this is so even the indoor load may be large.

That is, when it is determined that the start control is to be performed, the compressor 12 starts to operate and the receiver 170 may be filled with the refrigerant at the initial stage of the operation of the compressor, for example, just when the compressor 12 starts to operate. As a result, the amount of refrigerant circulating through the refrigeration system is controlled at the initial stage of operation of the compressor 12 so as to prevent pressure from being excessively increased in the refrigeration system. This ensures the cooling performance and efficiency of the refrigeration system in operations S17 and S18.

When a set time is elapsed after start control is performed, the refrigeration system is stabilized. Then, an on-time control is performed. When the refrigeration system is stabilized, a pressure value (and/or a temperature value) of the refrigeration cycle is within a set pressure range (and/or a set temperature range).

In on-time control, the receiver 170 is filled with refrigerant (or refrigerant is discharged from the receiver 170) based on at least one of a high pressure in the refrigeration system (a discharge pressure of compressor 12), a super cooling degree of the super cooler, or an amount of refrigerant stored in the receiver 170. This results in adjusting the amount of refrigerant circulating through the refrigeration system in operations S19 and S20.

If the outdoor temperature is lower than the reference temperature in operation S15, and/or if the indoor load is equal to or smaller than the reference load in operation S16, the start control is not performed. In this case, the compressor is driven to perform operation S19. That is, under a condition for performing operation S21, even though the on-time control is performed after the refrigeration system is stabilized, an appropriate amount of the refrigerant in the refrigeration system can be adjusted.

Figure 4:
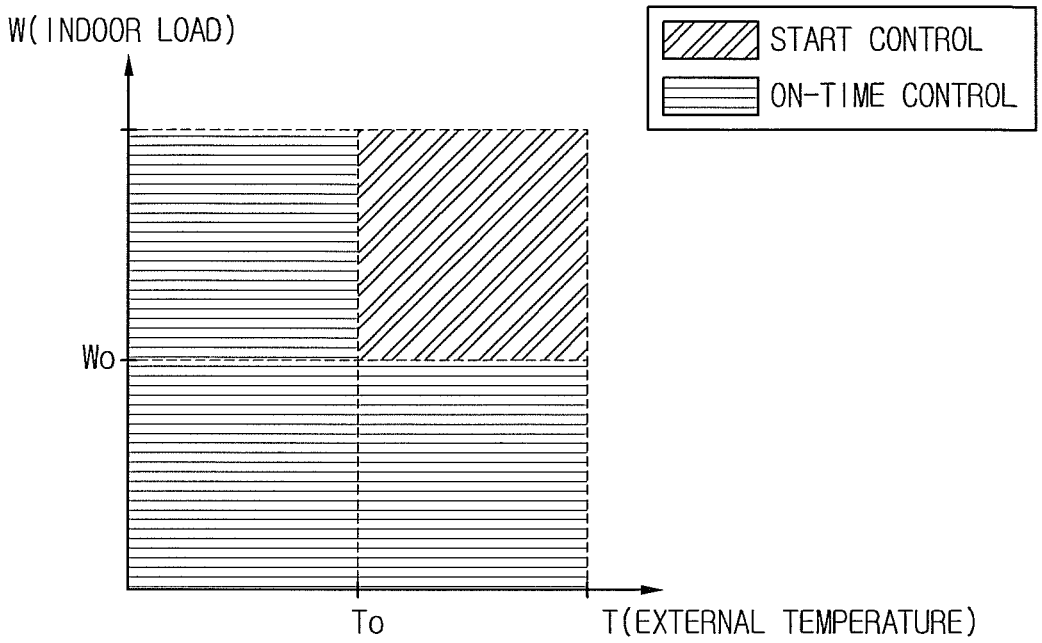
FIG. 4 shows a graph of states in which specific control operations are performed according to set conditions during the cooling operation in FIG. 3.

FIG. 4 is a graph showing an example of results that may be obtained in accordance with one or more of the aforementioned embodiments. As shown in the graph, when the air conditioner is performing a cooling operation, if an external temperature T is higher than a reference temperature T0 and/or an indoor load W is greater than a reference load W0, the start control is performed. If the external temperature T is higher than the reference temperature T0 and the indoor load W is smaller than the reference load W0, and if the external temperature T is lower than the reference temperature T0, when the refrigeration system is stabilized after the set time is elapsed, the on-time control may be performed.

Figure 5:
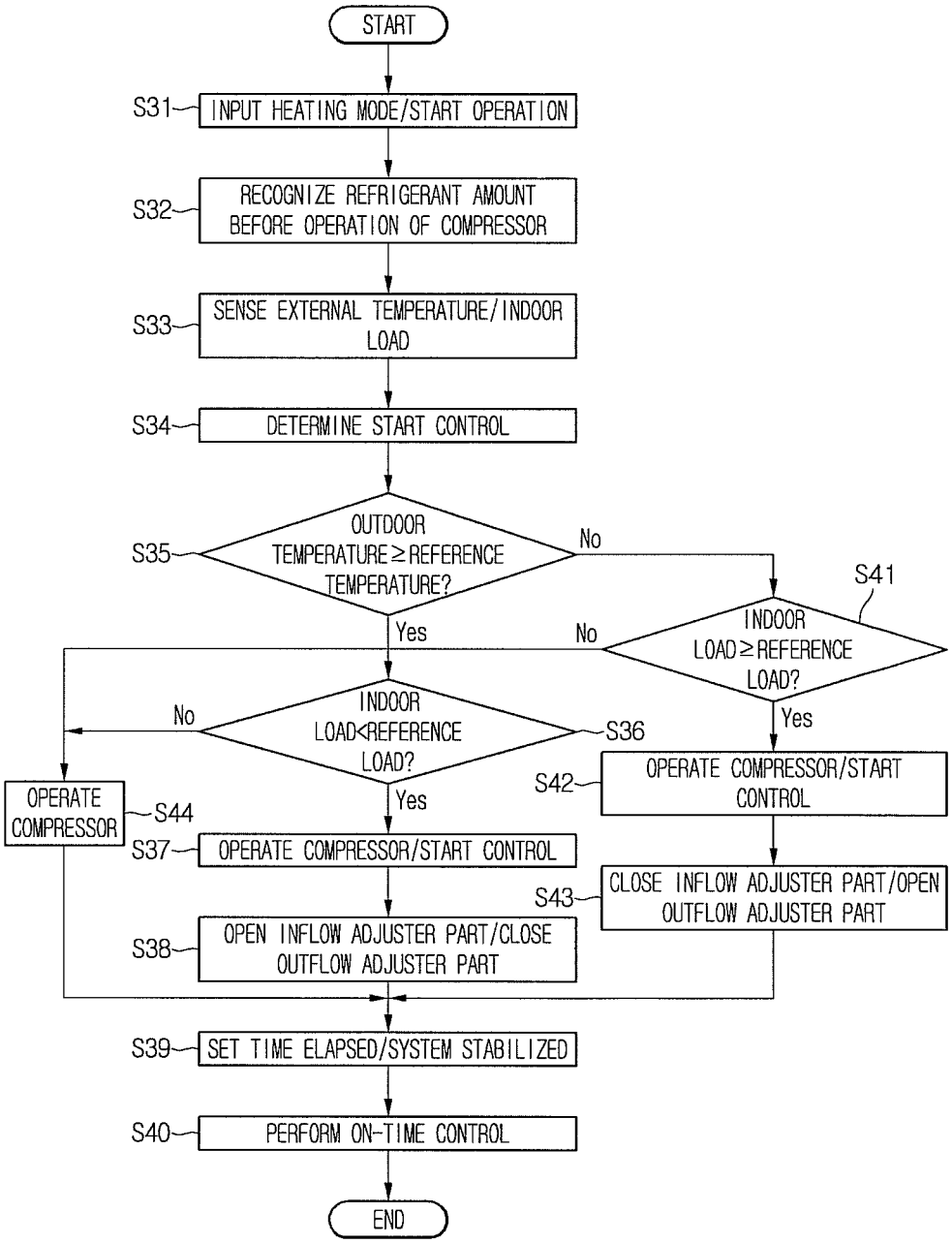
FIG. 5 shows operations included in one embodiment of a method for controlling an air conditioner during a heating operation.

FIG. 5 shows operations in a method of controlling an air conditioner during a heating operation. The air conditioner may be air conditioner 10 or an air conditioner has another structure.

When the air conditioner is set to enter the heating mode, the air conditioner starts to operate. This may be accomplished, for example, when a user turns the air conditioner 10 on and inputs a command to cause the air conditioner to enter the heating mode in operation S31.

Before the compressor 12 is driven, it is sensed whether an amount of refrigerant is excessive or insufficient according to a set condition in operation S32. The set condition may correspond to, for example, an external temperature (outdoor temperature) condition and/or an indoor load condition. The external temperature sensing part 110 and the indoor load sensing part 190 may respectively sense an external temperature value and an amount of indoor load in operation S33. Whether a start control of the air conditioner 10 is performed may be determined according to the external temperature value and/or the amount of indoor load in operation S34.

More specifically, a determination may be made as to whether an outdoor temperature is equal to or higher than a reference temperature in operation S35. If the outdoor temperature is equal to or higher than the reference temperature, it is determined whether the indoor load is smaller than a reference load in operation S36.

If the outdoor temperature is equal to or higher than the reference temperature and the indoor load is smaller than the reference load, the start control is performed. The start control is a control of filling the receiver 170 with refrigerant to decrease an amount of refrigerant circulating through a refrigeration system. That is, the inflow adjuster part 171 is opened to introduce refrigerant into the receiver 170 and the outflow adjuster part 172 is closed to prevent refrigerant from being discharged out of the receiver 170.

When outdoor temperature is high during a heating operation, the pressure in the refrigeration system (that is, a discharge pressure of the compressor 12) is increased. this point, when an amount of circulating refrigerant is increased, The high pressure in the refrigeration system (that occurs as a result of an increase in the amount of circulating refrigerant) degrades heating performance and efficiency and jeopardizes stability of the overall refrigeration system. In addition, since the indoor load is small in this case, the refrigeration system does not require a large amount of refrigerant. Thus, the receiver 170 is filled with refrigerant to decrease the amount of the refrigerant circulating through the refrigeration system.

More specifically, the compressor 12 may start to operate in accordance with the start control in operation S37, and the receiver 170 is filled with the refrigerant at the initial stage of the operation of the compressor. As a result, the amount of the refrigerant circulating through the refrigeration system is controlled at the initial stage of the operation of the compressor to prevent pressure from being excessively increased in the refrigeration system in operations S37 and S38. This may ensure favorable heating performance and efficiency of the refrigeration system. The start control in operation S37 may be referred to as a first start control.

When a set time has elapsed after start control is performed, the refrigerating system is stabilized. Then, on-time control is performed in operations S39 and S40. The on-time control may be performed in a same or similar manner as in FIG. 3.

If the outdoor temperature is lower than the reference temperature in operation S35, and/or if the indoor load is equal to or greater than the reference load in operation S41, start control is performed at the initial stage of operation of the compressor.

The start control may control discharge of refrigerant from receiver 170, to thereby increase the amount of refrigerant circulating through the refrigeration system. This may be accomplished by closing inflow adjuster part 171 to prevent refrigerant from being introduced into the receiver 170 and opening the outflow adjuster part 172 to discharge refrigerant from the receiver 170. The start control in operation S42 may be referred to as a second start control.

During the healing operation, when outdoor temperature is low and/or the amount of the refrigerant circulating through the refrigeration system is insufficient, low pressure (evaporation pressure) of the refrigeration system may occur to degrade heating performance. In this case, the amount of the refrigerant circulating through the refrigeration system may be increased to prevent the decrease of the low pressure.

When a set time has elapsed after the second start control is performed, the refrigeration system is stabilized. Then, on-time control may be performed in operations S39 and S40.

If the outdoor temperature is equal to or higher than the reference temperature and/or if the indoor load is equal to or greater than the reference load, the compressor may be operated in operation S44 to perform operation S39.

That is, although the outdoor temperature is equal to or higher than the reference temperature to increase the pressure, because an outdoor temperature condition of this case is different from the serious outdoor temperature condition of the cooling operation, the amount of refrigerant circulating through the refrigeration system may be maintained to correspond to the large indoor load. Then, the refrigeration system is stabilized and the on-time control is performed.

If the outdoor temperature is lower than the reference temperature and/or if the indoor load is smaller than the reference load, the compressor may be operated in operation S44 and then operation S39 may be performed. That is, although the outdoor temperature is low to decrease the pressure, because the indoor load is low the amount of refrigerant circulating through the system may be maintained to ensure efficiency. Then, the on-time control in operations S39 and s40 may be performed.

Figure 6:
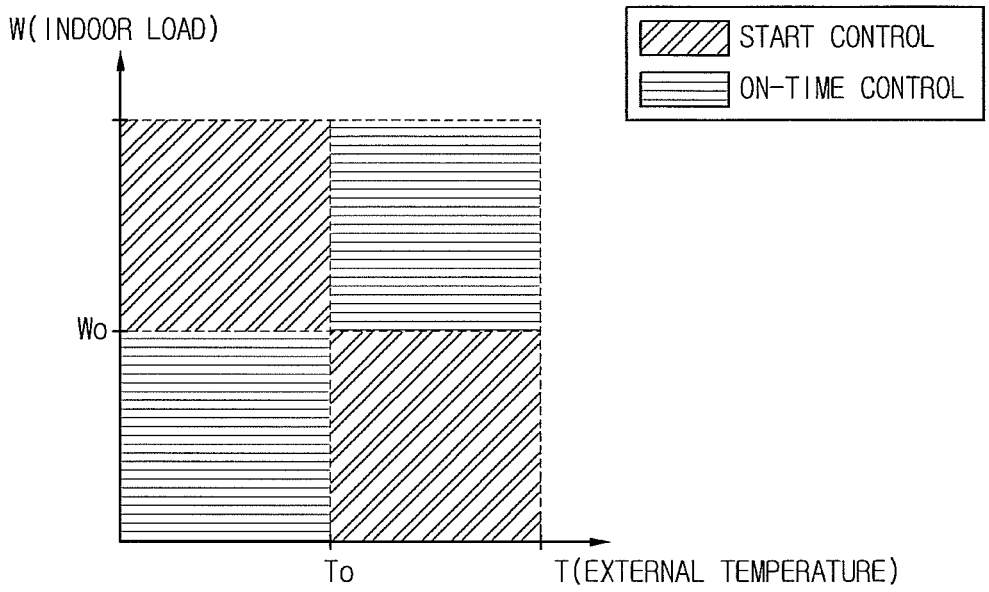
FIG. 6 shows a graph of states in which specific control operations are performed according to set conditions during the heating operation of FIG. 5.

FIG. 6 is a graph showing that, when the air conditioner is performing a heating operation, if an external temperature T is higher than a reference temperature T0 and an indoor load W is smaller than a reference load W0, the first start control is performed. If the external temperature T is lower than reference temperature T0 and indoor load W is greater than reference load W0, the second start control is performed.

If external temperature T is higher than reference temperature T0 and indoor load W is greater than reference load W0, and if external temperature T is lower than reference temperature T0, and indoor load W is lower than the reference load W0, the on-time control may be performed when the refrigeration system is stabilized after the set time has elapsed.

Figure 7:
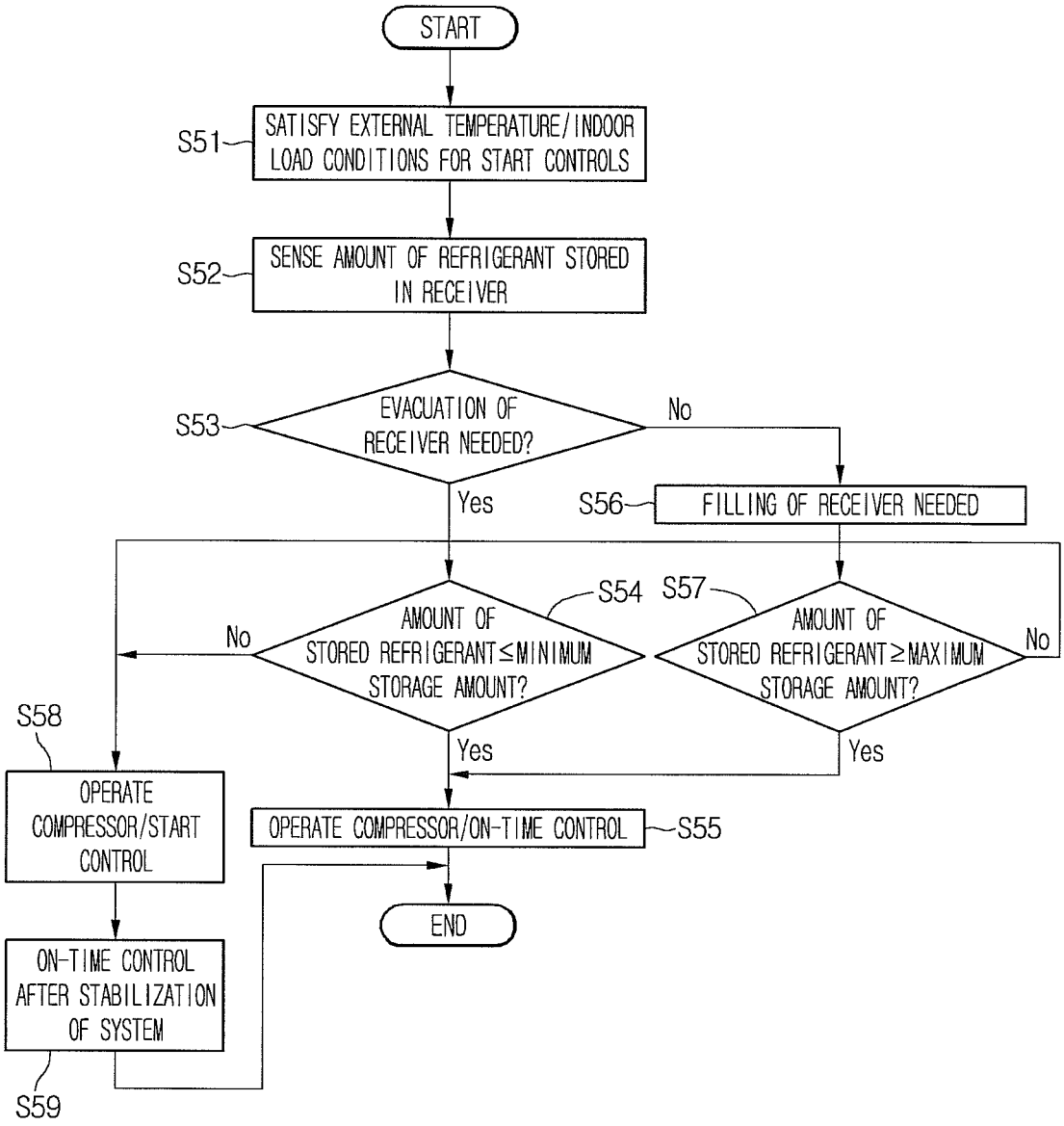
FIG. 7 shows operations included in another embodiment of a method for controlling an air conditioner.

FIG. 7 shows operations included in another embodiment of a method for controlling an air conditioner. In this method, when the start control (in the cooling operation) of FIG. 3 and the first and second start controls (in the heating operation) of FIG. 5 are performed (that is, when the air conditioner satisfies the external temperature/indoor load conditions for performing the start controls), the amount of refrigerant stored in receiver 170 may be sensed in operations S51 and S52.

Even though it is needed to evacuate the receiver 170 (that is, even though the second start control of the heating operation is needed in operation S53), if the amount of refrigerant in receiver 170 is equal to or lower than the minimum storage amount in operation S54, the second start control is not performed. For example, when the amount of refrigerant stored in the receiver 170 is very small (e.g., less than a predetermined amount), because the receiver 170 is not evacuated the compressor 12 is operated to perform the on-time control without the second start control in operation S55.

If the amount of refrigerant in receiver 170 is greater than the minimum (or predetermined) storage amount in operation S54, start control is performed. That is, receiver 170 may be evacuated in operation S58. When the refrigeration system is stabilized after a set time has elapsed, the on-time control may be performed in operation S59.

If it is determined in operation S53 that evacuation of receiver 170 is not needed, it is determined that filling receiver 170 with refrigerant is needed. That is, it is determined in operation S56 that the start control in the cooling operation, or the first start control in the heating operation, is needed.

When it is determined that filling the receiver 170 with refrigerant is needed, it is determined whether the amount of the refrigerant stored in the receiver 170 is equal to or greater than the maximum (or a predetermined) storage amount. If the amount of the refrigerant in receiver 170 is equal to or greater than the maximum (or predetermined) storage amount in operation S57, even though it is determined that filling of the receiver 170 with refrigerant is needed, a corresponding start control is not performed.

That is, when the amount of refrigerant stored in receiver 170 is very great, because receiver 170 is not filled, the compressor is operated to perform on-time control without start control in operation S55. On the contrary, if the amount of refrigerant in receiver 170 is smaller than the maximum (or predetermined) storage amount, operation S58 is performed.

Because receiver 170 is filled or evacuated based on the amount of refrigerant stored in receiver 170, the amount of refrigerant circulating through the refrigeration system can be maintained at an appropriate level and the refrigeration system can be stabilized.

In accordance with one embodiment, before the air conditioner is operated, a set condition is recognized to determine whether refrigerant amount is to be adjusted. When the air conditioner is operated, the refrigerant amount is adjusted based on a sensed refrigerant amount. Thus, the refrigeration system can be stabilized at the initial stage of the operation of the air conditioner.

In accordance with one embodiment, an optimal amount of refrigerant may be controlled to circulate through the refrigeration system; that is, optimal pressure of the refrigeration system can be controlled according to the cooling operation, the heating operation, the outdoor temperature condition, and/or the indoor load condition, thereby improving heating and cooling performance and operational efficiency.

In accordance with one embodiment, an air conditioner includes: an outdoor unit including a compressor and an outdoor heat exchanger; at least one indoor unit connected to the outdoor unit and including an indoor heat exchanger; a refrigerant tube connecting the outdoor unit to the indoor unit; a receiver storing at least one portion of refrigerant flowing through the refrigerant tube; an external temperature sensing part disposed on the outdoor unit to sense outdoor temperature; an indoor load sensing part sensing an operation capacity of the indoor unit; and a control part adjusting an amount of refrigerant to be stored in the receiver, based on at least one of values sensed by the external temperature sensing part and the indoor load sensing part.

In accordance with another embodiment, a method of controlling an air conditioner including a receiver that temporarily stores at least one portion of refrigerant circulating through a refrigerant tube, and then, selectively supplies the refrigerant to the refrigerant tube includes: recognizing an operation mode and operation command of the air conditioner; recognizing at least one of an outdoor temperature and an indoor load before an operation of a compressor according to the operation command of the air conditioner; operating the compressor; and adjusting an amount of refrigerant introduced into or discharged from the receiver, based on a condition corresponding to the outdoor temperature and indoor load.

Because the performance of the refrigeration cycle can be controlled by adjusting the amount of refrigerant circulating through the refrigeration system without changing an operation rate of the compressor according to an indoor load, the entire operation efficiency of the air conditioner can be improved.

In accordance with another embodiment, an air conditioner comprises an outdoor unit comprising a compressor and an outdoor heat exchanger; at least one indoor unit comprising an indoor heat exchanger; a conduit coupling the outdoor and indoor units; a receiver to store a portion of refrigerant flowing through the conduit; a first sensor to determine external temperature; a second sensor to determine load of the indoor unit; and a controller to adjust an amount of refrigerant to be stored in the receiver based on information from at least one of the first sensor or the second sensor.

The controller may adjust the amount of refrigerant to be stored in the receiver based on an operation mode of the air conditioner and at least one of: a comparison of the external temperature determined by the first sensor to an external temperature reference condition, or a comparison of the load of the indoor unit determined by the second sensor to an indoor load reference condition.

The controller may increase an amount of refrigerant to be stored in the receiver when: the air conditioner is in a cooling mode, the load of the indoor unit is greater than a reference load, and the external temperature is equal to or higher than a reference temperature.

The controller may increase the amount of refrigerant to be stored in the receiver when: the air conditioner is in a heating mode, the load of the indoor unit is smaller than a reference load, and the external temperature is equal to or higher than a reference temperature.

The controller may decrease the amount of refrigerating to be stored in the receiver when: the air conditioner is in a heating mode, the external temperature is lower than a reference temperature, and the load of the indoor unit is equal to or greater than a reference load.

The air conditioner may further include a third sensor to determine an amount of refrigerant stored in the receiver, a first adjuster to adjust an amount of refrigerant flowing into the receiver; and a second adjuster to adjust an amount of refrigerant flowing from the receiver.

The first adjuster may be closed to prevent refrigerant from flowing into the receiver when: the amount of the refrigerant to be stored in the receiver is to be increased based on the information from at least one of the first sensor or second sensor, and the refrigerant amount determined by the third sensor is equal to or greater than a set refrigerant amount.

The second adjuster may be closed to prevent refrigerant from flowing from the receiver when: the amount of refrigerant to be stored in the receiver is to be decreased based on the information from at least one of the first sensor or the second sensor, and the refrigerant amount determined by the third sensor is less than a set refrigerant amount.

The third sensor may comprise a first level sensor to detect whether an amount of refrigerant in the receiver is equal to or smaller than a first predetermined storage amount; and a second level sensor to determine whether the amount of refrigerant in the receiver is equal to or greater than a second predetermined storage amount greater than the first predetermined storage amount.

The third sensor may comprises a third level sensor to determine whether the amount of refrigerant in the receiver is between the first and second predetermined storage amounts.

The controller may adjust the amount of refrigerant to be stored in the receiver from an initial stage of an operation of the compressor to a stage in which a pressure value of a refrigerating cycle is within a set pressure range. Also, a super cooler may super-cool refrigerant passing through the outdoor heat exchanger or the indoor heat exchanger, and the controller may adjust the amount of refrigerant to be stored in the receiver based on at least one of a discharge pressure of the compressor, a super cooling degree of the super cooler, or an amount of refrigerant stored in the receiver after the pressure value is within the set pressure range.

The air conditioner may also include a capillary tube disposed at an inlet side or an outlet side of the receiver, wherein the capillary tube is to limit a flow speed of refrigerant introduced into or discharged from the receiver to a predetermined speed or lower.

In accordance with another embodiment, a method of controlling an air conditioner comprises: determining an operational mode of the air conditioner; determining at least one of an external temperature or a load of an indoor unit before operation of a compressor corresponding to the operational mode; operating the compressor; and adjusting an amount of refrigerant to be introduced into or discharged from a receiver based on at least one of the external temperature or load of the indoor unit, wherein the refrigerant is to be introduced into the receiver from or discharged from the receiver to a conduit coupled between the indoor unit and an outdoor unit.

The amount of the refrigerant to be introduced into or discharged from the receiver may be adjusted during a period between initiation of operation of the compressor and a time when pressure corresponding to a refrigeration cycle falls within a predetermined pressure range.

The refrigerant may be introduced into the receiver and refrigerant in the receiver may be prevented from being discharged when: the air conditioner is in a cooling mode, the load of the indoor unit is greater than a reference load, and the external temperature is equal to or higher than a reference temperature.

The refrigerant may be introduced into the receiver and refrigerant in the receiver may be prevented from being discharged when: the air conditioner is in a heating mode, the load of the indoor unit is smaller than a reference load, and the external temperature is equal to or higher than a reference temperature.

The refrigerant in the receiver may be discharged to the conduit and refrigerant may be prevented from being introduced into the receiver when: the air conditioner is in a heating mode, the external temperature is lower than a reference temperature, and the load of the indoor unit is equal to or greater than a reference load. Substantially a same amount of refrigerant may be maintained in the receiver when the amount of refrigerant in the receiver is greater than a set level.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments. The features of one embodiment may be combined with the features of one or more of the other embodiments.

Although embodiments have been described with reference to a number of illustrative embodiments, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. An air conditioner comprising:

an outdoor device comprising a compressor and an outdoor heat exchanger;

at least one indoor device comprising an indoor heat exchanger;

a conduit that couples the outdoor and indoor devices;

a receiver to store a portion of refrigerant flowing through the conduit;

a first sensor to determine an external temperature;

a second sensor to determine a load of the at least one indoor device; and a controller to adjust an amount of refrigerant stored in the receiver based on information from at least one of the first sensor or the second sensor, wherein the controller increases the amount of refrigerant stored in the receiver when the air conditioner is in a first operation mode, the load of the at least one indoor device is greater than a reference load, and the external temperature is equal to or higher than a reference temperature, and wherein the controller increases the amount of refrigerant stored in the receiver when the air conditioner is in a second operation mode, the load of the at least one indoor device is smaller than the reference load, and the external temperature is equal to or higher than the reference temperature.

2. The air conditioner of claim 1, wherein the controller decreases the amount of refrigerant stored in the receiver when the air conditioner is in the second operation mode, the external temperature is lower than the reference temperature, and the load of the indoor device is equal to or greater than the reference load.

3. The air conditioner of claim 1, further comprising:

a third sensor to determine an amount of refrigerant stored in the receiver.

4. The air conditioner of claim 3, further comprising:

a first adjuster to adjust an amount of refrigerant flowing into the receiver; and a second adjuster to adjust an amount of refrigerant flowing from the receiver.

5. The air conditioner of claim 4, wherein the first adjuster is closed to prevent refrigerant from flowing into the receiver when the amount of the refrigerant stored in the receiver is increased based on the information from at least one of the first sensor or second sensor, and the refrigerant amount determined by the third sensor is equal to or greater than a set refrigerant amount.

6. The air conditioner of claim 4, wherein the second adjuster is closed to prevent refrigerant from flowing from the receiver when the amount of refrigerant stored in the receiver is decreased based on the information from at least one of the first sensor or the second sensor, and the refrigerant amount determined by the third sensor is less than a set refrigerant amount.

7. The air conditioner of claim 3, wherein the third sensor comprises:

a first level sensor to detect whether an amount of refrigerant in the receiver is equal to or smaller than a first predetermined storage amount; and a second level sensor to determine whether the amount of refrigerant in the receiver is equal to or greater than a second predetermined storage amount greater than the first predetermined storage amount.

8. The air conditioner of claim 7, wherein the third sensor comprises:

a third level sensor to determine whether the amount of refrigerant in the receiver is between the first and second predetermined storage amounts.

9. The air conditioner of claim 1, wherein the controller adjusts the amount of refrigerant stored in the receiver from an initial stage of an operation of the compressor to a stage in which a pressure value of a refrigerating cycle is within a set pressure range.

10. The air conditioner of claim 9, further comprising:

a super cooler to super-cool refrigerant passing through the outdoor heat exchanger or the indoor heat exchanger, wherein the controller adjusts the amount of refrigerant stored in the receiver based on at least one of a discharge pressure of the compressor, a super cooling degree of the super cooler, or an amount of refrigerant stored in the receiver after the pressure value is within the set pressure range.

11. The air conditioner of claim 1, further comprising:

a capillary tube disposed at an inlet side or an outlet side of the receiver, wherein the capillary tube limits a flow speed of refrigerant introduced into or discharged from the receiver to a predetermined speed or lower.

12. The air conditioner of claim 1, wherein the at least one indoor device comprises a plurality of indoor devices, each including an indoor heat exchanger.

13. The air conditioner of claim 12, wherein the load measured by the second sensor corresponds to information that relates to an operation ratio of the plurality of indoor devices.

14. A method of controlling an air conditioner, the method comprising:

determining an operational mode of the air conditioner;

determining at least one of an external temperature or a load of an indoor device before operation of a compressor corresponding to the operational mode;

operating the compressor; and adjusting an amount of refrigerant introduced into or discharged from a receiver based on at least one of the external temperature or the load of the indoor device, wherein the refrigerant is introduced into the receiver from or discharged from the receiver to a conduit coupled between the indoor device and an outdoor device, wherein refrigerant is introduced into the receiver and refrigerant in the receiver is prevented from being discharged when the air conditioner is in a first operation mode, the load of the indoor device is greater than a reference load, and the external temperature is equal to or higher than a reference temperature, and wherein refrigerant is introduced into the receiver and refrigerant in the receiver is prevented from being discharged when the air conditioner is in a second operation mode, the load of the indoor device is smaller than a reference load, and the external temperature is equal to or higher than a reference temperature.

15. The method of claim 14, wherein the amount of the refrigerant introduced into or discharged from the receiver is adjusted during a period between initiation of operation of the compressor and a time when pressure corresponding to a refrigeration cycle falls within a predetermined pressure range.

16. The method of claim 14, wherein the refrigerant in the receiver is discharged to the conduit and refrigerant is prevented from being introduced into the receiver when the air conditioner is in the second operation mode, the external temperature is lower than the reference temperature, and the load of the indoor device is equal to or greater than the reference load.

17. The method of claim 14, wherein the refrigerant is introduced into the receiver by opening a first adjuster and the refrigerant in the receiver is prevented from being discharged by closing a second adjuster.

* * * * *